US007997670B2

(12) United States Patent
Taira et al.

(10) Patent No.: US 7,997,670 B2
(45) Date of Patent: Aug. 16, 2011

(54) LIQUID-EJECTION APPARATUS

(75) Inventors: Hiroshi Taira, Ichinomiya (JP); Tadanobu Chikamoto, Nagoya (JP); Shuichi Tamaki, Nagoya (JP); Noritsugu Ito, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/536,442

(22) Filed: Aug. 5, 2009

(65) Prior Publication Data

US 2010/0079513 A1 Apr. 1, 2010

(30) Foreign Application Priority Data

Sep. 26, 2008 (JP) ..... 2008-248099

(51) Int. Cl.
*B41J 29/38* (2006.01)

(52) U.S. Cl. ..... 347/6; 347/7; 347/17; 347/85; 347/89; 347/92

(58) Field of Classification Search ..... None
See application file for complete search history.

(56) References Cited

U.S. PATENT DOCUMENTS

| | | | | |
|---|---|---|---|---|
| 7,399,075 | B2 | 7/2008 | Nomura et al. | |
| 2007/0211121 | A1* | 9/2007 | Hashimoto | 347/86 |
| 2008/0089041 | A1* | 4/2008 | Aruga | 361/752 |
| 2008/0204506 | A1* | 8/2008 | Nakamura et al. | 347/30 |
| 2009/0009569 | A1* | 1/2009 | Sasaki | 347/85 |
| 2009/0284572 | A1 | 11/2009 | Katoh | |

FOREIGN PATENT DOCUMENTS

CN 101034706 A 9/2007

(Continued)

OTHER PUBLICATIONS

Machine translation of JP 2003-275659 A.*

(Continued)

*Primary Examiner* — Matthew Luu
*Assistant Examiner* — Justin Seo
(74) *Attorney, Agent, or Firm* — Baker Botts L.L.P.

(57) ABSTRACT

A liquid-ejection apparatus, including: a head configured to eject a liquid from a plurality of liquid-ejection openings; a main tank configured to accommodate the liquid supplied to the head; a liquid-supply pump configured to supply the liquid in the main tank to the head; a sub-tank in which are formed (a) a connection opening for connecting the sub-tank to the head and (b) an air-discharge opening for communicating the sub-tank with ambient air; a first channel extending from the liquid-supply pump to the sub-tank via the head and the connection opening; a second channel extending from the sub-tank to the liquid-supply pump; a third channel extending from the air-discharge opening of the sub-tank to the ambient air; an air-discharge valve provided in the third channel so as to be openable and closable; and a controller configured to control the air-discharge valve such that the air-discharge valve is temporarily opened in a liquid introducing operation in which the liquid is introduced from the main tank to the liquid-supply pump and an air discharging operation in which air separated from the liquid in the sub-tank by causing the liquid to be flowed through the first channel by driving of the liquid-supply pump is discharged through the third channel, and such that the air-discharge valve is closed in times other than the liquid introducing operation and the air discharging operation.

24 Claims, 8 Drawing Sheets

FOREIGN PATENT DOCUMENTS

| | | | |
|---|---|---|---|
| JP | 2003-275659 | A | 9/2003 |
| JP | 2005-271333 | A | 10/2005 |
| JP | 2005-306005 | A | 11/2005 |
| JP | 2006-150745 | A | 6/2006 |
| JP | 2007-152830 | A | 6/2007 |
| JP | 2007-203649 | A | 8/2007 |
| JP | 2008-194989 | A | 8/2008 |

OTHER PUBLICATIONS

Machine translation of JP 2007-152830 A.*
Machine translation of JP 2005-271333 A.*
Machine translation of JP 2006-150745 A.*
Translation of JP 2005-271333 A.*
Translation of JP 2006-150745 A.*
Translation of JP 2007-152830 A.*
Translation of JP 2007-203649 A.*
Japan Patent Office, Notification of Reason for Refusal for Japanese Patent Application No. 2008-248099 (counterpart to above-captioned patent application), mailed Jul. 6, 2010.
The State Intellectual Property Office of the People's Republic of China, Notification of First Office Action for Chinese Patent Application No. 200910173522.0 (counterpart to above-captioned patent application), issued Jan. 12, 2011.

* cited by examiner

LIQUID-EJECTION APPARATUS

CROSS REFERENCE TO RELATED APPLICATION

The present application claims priority from Japanese Patent Application No. 2008-248099, which was filed on Sep. 26, 2008, the disclosure of which is herein incorporated by reference in its entirety.

BACKGROUND OF THE INVENTION

1. Field of the Invention

The present invention relates to a liquid-ejection apparatus including a sub-tank which discharges air in a channel including a liquid-ejection head.

2. Description of the Related Art

As an ink-jet printer as an example of a liquid-ejection apparatus, there is conventionally known a technique, with reference to Patent Document 1 (U.S. Pat. No. 7,399,075 B2 corresponding to JP-A-2005-306005), that a sub-tank is provided, in addition to a main tank for accommodating an ink supplied to a liquid-ejection head, in order to discharge air in a channel including the head to an outside, for example. The sub-tank accommodates the ink and is communicated at an upper portion thereof with ambient air. When an ink with which air bubbles are mixed is supplied from the head into the sub-tank, the air bubbles are moved upward in the sub-tank to be discharged from the upper portion thereof to the ambient air.

SUMMARY OF THE INVENTION

According to the above-described Patent Document 1, an ambient-air-communicated valve which communicates the sub-tank with the ambient air is temporarily closed in a predetermined operation, but is kept opened in times other than the predetermined operation in order to resolve a pressure difference between the sub-tank and the head. Thus, since the ink in the channel including the head is exposed to the ambient air for a relatively long time, a viscosity of the ink rises, thereby causing a problem that the ink is ejected unstably.

This invention has been developed in view of the above-described situations, and it is an object of the present invention to provide a liquid-ejection apparatus which is configured to include a sub-tank for discharging air in a channel including a liquid-ejection head and which is allowed to assure ink-ejection stability.

The object indicated above may be achieved according to the present invention which provides a liquid-ejection apparatus, comprising: a head configured to eject a liquid from a plurality of liquid-ejection openings; a main tank configured to accommodate the liquid supplied to the head; a liquid-supply pump configured to supply the liquid in the main tank to the head; a sub-tank in which are formed (a) a connection opening for connecting the sub-tank to the head and (b) an air-discharge opening for communicating the sub-tank with ambient air; a first channel extending from the liquid-supply pump to the sub-tank via the head and the connection opening; a second channel extending from the sub-tank to the liquid-supply pump; a third channel extending from the air-discharge opening of the sub-tank to the ambient air; an air-discharge valve provided in the third channel so as to be openable and closable; and a controller configured to control the air-discharge valve such that the air-discharge valve is temporarily opened in a liquid introducing operation in which the liquid is introduced from the main tank to the liquid-supply pump and an air discharging operation in which air separated from the liquid in the sub-tank by causing the liquid to be flowed through the first channel by driving of the liquid-supply pump is discharged through the third channel, and such that the air-discharge valve is closed in times other than the liquid introducing operation and the air discharging operation.

In the liquid-ejection apparatus constructed as described above, since the controller controls the air-discharge valve to be kept closed in the times other than a predetermined period, the liquid in a channel including the head is not exposed to the ambient air for a relatively long time. Thus, a problem that the liquid is ejected unstably owing to a rise of a viscosity of the liquid does not arise, thereby assuring ink-ejection stability.

BRIEF DESCRIPTION OF THE DRAWINGS

The objects, features, advantages, and technical and industrial significance of the present invention will be better understood by reading the following detailed description of a preferred embodiment of the invention, when considered in connection with the accompanying drawings, in which.

DESCRIPTION OF THE PREFERRED EMBODIMENT

Hereinafter, there will be described a preferred embodiment of the present invention by reference to the drawings.

Initially, there will be explained a structure of an ink-jet printer 1 as an embodiment of the present invention with reference to FIG. 1.

Figure 1:
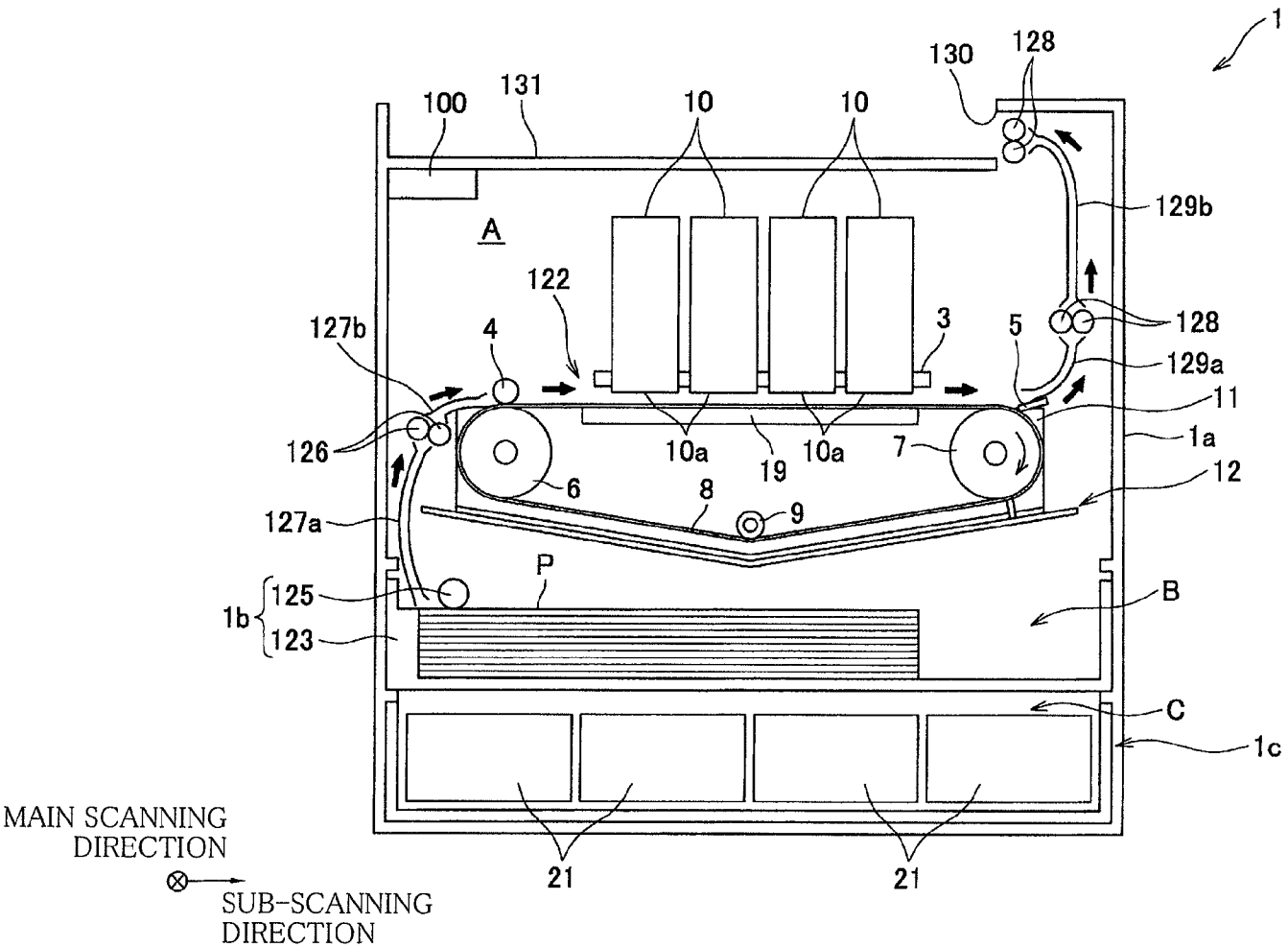
FIG. 1 is a side view of an ink-jet printer as an embodiment of the present invention.

As shown in FIG. 1, the ink-jet printer 1 has a body 1*a* having a rectangular parallelepiped shape. On an upper portion of a top plate of the body 1*a*, there is formed a sheet-discharge portion 131 which receives each recorded recording sheet P having been subjected to recording and discharged from an opening 130. An inside space of the body 1*a* is separated into spaces A, B, C in order from above. In the space A, there are disposed four ink-jet heads 10 which respectively eject inks (i.e., liquids) of four colors, namely, magenta, cyan, yellow, and black, and a sheet-feed unit 122 which feeds each recording sheet P. Each of the heads 10 are disposed such that a longitudinal direction thereof coincides with a main scanning direction in which the head 10 reciprocates, and the sheet-feed unit 122 feeds each sheet P in a sub-scanning direction. In the spaces B and C, there are respectively disposed a sheet-supply unit 1*b* and an ink tank unit 1*c* attachable to and detachable from the body 1*a* in the main scanning direction.

Figure 2:
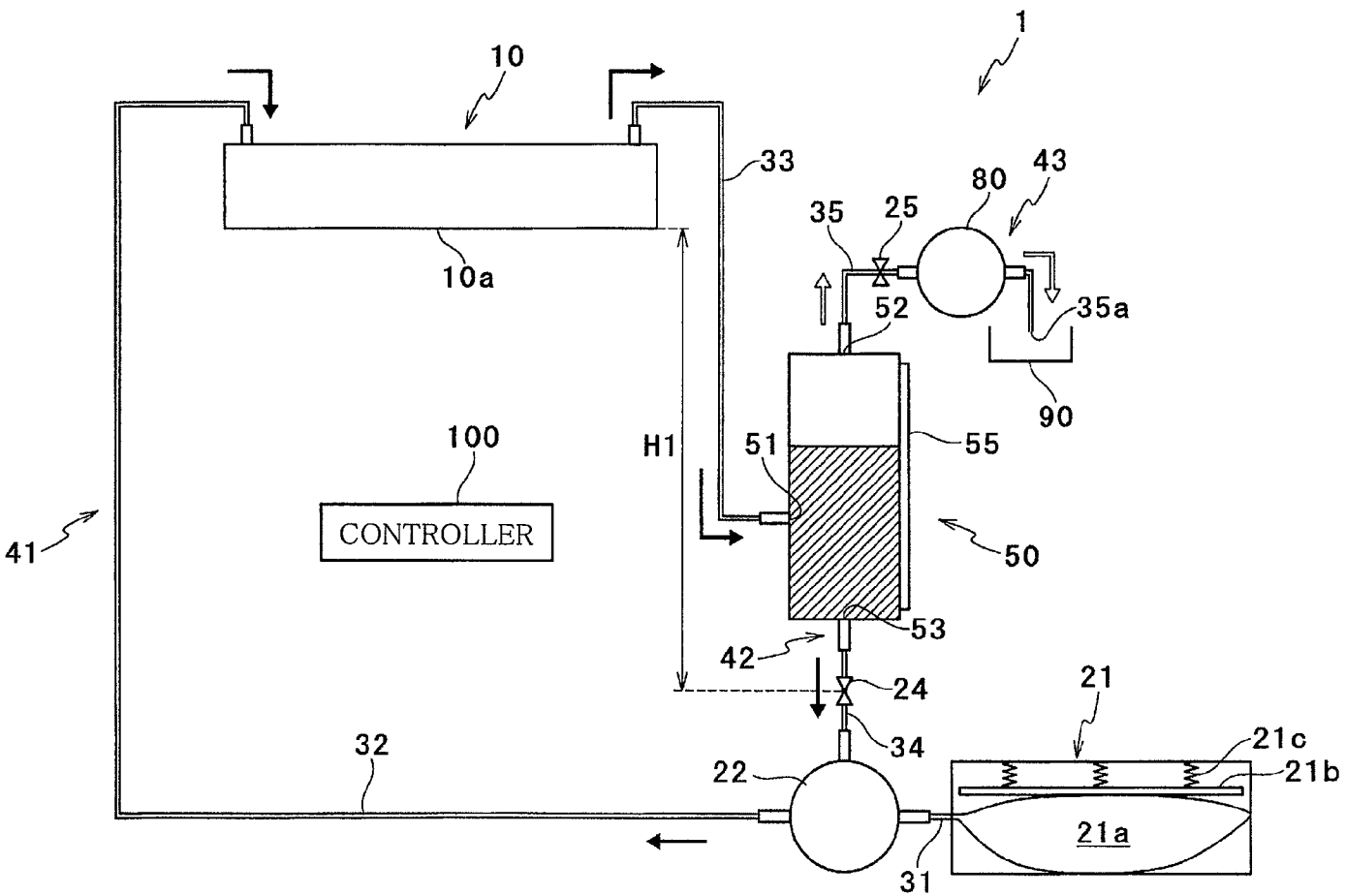
FIG. 2 is a schematic view showing an ink-supply system in the ink-jet printer in FIG. 1.

The ink tank unit 1*c* includes four main tanks 21 accommodating the respective inks of the four colors respectively corresponding to the four heads 10. As shown in FIG. 2, the main tanks 21 are respectively connected to the heads 10 via tubes 32 or the like. The sheet-supply unit 1*b* includes a sheet-supply tray 123 which can accommodate a plurality of the sheets P, and a sheet-supply roller 125 attached to the sheet-supply tray 123. The sheets P accommodated in the sheet-supply tray 123 are supplied one by one from an uppermost one of the sheets P by the sheet-supply roller 125 and fed to the sheet-feed unit 122 while being guided by guides 127*a*, 127*b* and being nipped between a pair of feed rollers 126.

The sheet-feed unit 122 includes (a) two belt rollers 6, 7, (b) an endless sheet-feed belt 8 wound around the rollers 6, 7 so as to bridge the rollers 6, 7, (c) a tension roller 9 which applies tension to the sheet-feed belt 8 by being biased downward while contacting with an inner peripheral surface of the sheet-feed belt 8 at a lower portion thereof, and (d) a support frame 11 supporting the rollers 6, 7, 9 such that the rollers 6, 7, 9 are rotatable. When the belt roller 7 as a drive roller is rotated in a clockwise direction in FIG. 1, the sheet-feed belt 8 is rotated, whereby the belt roller 6 is also rotated in the clockwise direction in FIG. 1.

An upper portion of the sheet-feed belt 8 is supported by a platen 19 such that a belt surface of the sheet-feed belt 8 at the upper portion is distant by a predetermined distance from lower surfaces 10*a* of the respective heads 10 (each of which functions as an ink-ejection surface in which a plurality of ink-ejection openings for ejecting the corresponding ink are formed and such that the belt surface extends parallel to the lower surfaces 10*a*. The four heads 10 are arranged side by side in the sub-scanning direction and supported by the body 1*a* via a frame 3.

Under the sheet-feed unit 122, there is disposed a safety plate 12 which is bent in a shallow V-shape and holds foreign materials fallen or dropped from the sheet-feed belt 8 or the like.

On a front surface of the sheet-feed belt 8 is formed a silicone layer having a weak viscosity. The sheet P fed to the sheet-feed unit 122 is pressed onto the front surface of the sheet-feed belt 8 by a pressing roller 4, and then fed in the sub-scanning direction along boldface arrow while being held by and on the front surface of the sheet-feed belt 8 owing to the viscosity thereof. When the sheet P is fed or passed through just under the four heads 10, the inks are sequentially ejected onto an upper surface of the sheet P from the ink-ejection surfaces 10*a* of the respective heads 10, thereby forming a desired color image on the sheet P. Then, the sheet P is peeled from the front surface of the sheet-feed belt 8 by a peeling plate 5 and fed upward while being guided by guides 129*a*, 129*b* and being nipped between two pairs of feed rollers 128. Then, the sheet P is discharged to the sheet-discharge portion 131 from the opening 30 formed in the upper portion of the body 1*a*.

There will be next explained, with reference to FIG. 2, ink-supply systems in the ink-jet printer 1 in FIG. 1. The ink-supply systems are provided respectively for the four heads 10 and each includes the corresponding main tank 21, an ink-supply pump (liquid-supply pump) 22 which supplies the ink in the main tank 21 to the corresponding head 10, the head 10, and a sub-tank 50 which separates the ink and air from each other. Hereinafter, there will be explained an ink-supply system corresponding to one of the heads 10, but a content of the explanation is common to the ink-supply system of each of the heads 10.

The main tank 21 and the ink-supply pump 22 are connected to each other by a tube 31. The ink-supply pump 22 and the head 10 are connected to each other by the tube 32. The head 10 and the sub-tank 50 are connected to each other by a tube 33. The sub-tank 50 and the ink-supply pump 22 are connected to each other by a tube 34. FIG. 2 is a view in which the printer 1 in FIG. 1 is seen in a direction along the sub-scanning direction. The sub-tank 50, the ink-supply pump 22, the tubes 31, 32, 33, 34, a controller 100, and so on are disposed in the body 1*a* (with reference to FIG. 1) so as to have positional relationships in a vertical direction shown in FIG. 2.

The main tank 21 includes an ink bag 21*a* filled with the ink, a pressure-apply plate (pressure-apply portion) 21*b* disposed on an upper portion of the ink bag 21*a* in a state the pressure-apply plate 21*b* can press the ink bag 21*a*, and a biasing member 21*c* which biases the pressure-apply plate 21*b* downward. The ink bag 21*a*, the pressure-apply plate 21*b*, and the biasing member 21*c* are disposed in a tank casing. When the pressure-apply plate 21*b* is moved downward by the control of the controller 100, a pressure is applied to the ink bag 21*a* by pressing of the pressure-apply plate 21*b*, whereby the ink in the ink bag 21*a* is introduced to the ink-supply pump 22. That is, the main tank 21 is disposed such that the ink in the ink bag 21*a* applies a positive pressure to the ink-supply pump 22 in "ink introduction" or a liquid introducing operation which will be described below.

The biasing member 21*c* is shown as a spring in FIG. 2, but may be an actuator using a solenoid, a pressing mechanism using a ling mechanism, and so on. In any case, an amount of displacement of the biasing member 21*c* is controlled by the controller 100.

The sub-tank 50 has a hollow cylindrical shape. In a lower portion of a side face of the sub-tank 50 is formed a connection opening 51 for connecting the sub-tank 50 to the head 10. In an upper end of the sub-tank 50 is formed an air-discharge opening 52 for communicating the sub-tank 50 with the ambient air. In a lower end of the sub-tank 50 is formed a circulation opening 53 for connecting the sub-tank 50 to the ink-supply pump 22. Further, on another side face of the sub-tank 50 is provided a sensor (detecting portion) 55 which detects a position of a liquid surface in the sub-tank 50.

The air-discharge opening 52 of the sub-tank 50 is connected to one end of a tube 35. In the other end of the tube 35, there is formed an ambient-air-communicating opening 35*a* to which air in the sub-tank 50 is discharged from the air-discharge opening 52 by driving of an air-discharge pump 80 disposed on the tube 35. Further, a waste-ink receiver 90 is provided near the ambient-air-communicating opening 35*a* such that where a small amount of the ink in the sub-tank 50 is accidentally discharged in discharging of the air in the sub-tank 50, the ink does not flown into the printer 1.

In the printer 1, there are formed a first channel 41, a second channel 42, and the third channel 43. The first channel 41 extends from the ink-supply pump 22 to the sub-tank 50 via the tube 32, the head 10, the tube 33, and the connection opening 51. The second channel 42 extends from the sub-tank 50 to the ink-supply pump 22 via the tube 34 and the circulation opening 53. The third channel 43 extends from the sub-tank 50 to the ambient air via the air-discharge opening 52, the tube 35 and the ambient-air-communicating opening 35*a*. In the tube 34 partly constituting the second channel 42 is provided an open-close valve 24. In the tube 35 partly constituting the third channel 43 is provided an openable and closable air-discharge valve 25 such that the air-discharge pump 80 is disposed at a position further from the air-discharge opening 52 than the air-discharge valve 25.

The head 10 includes the ink-ejection surface 10*a* in which the plurality of the ink-ejection openings are formed, and is disposed such that the ink-ejection surface 10*a* horizontally extends and is located at a position higher in the vertical direction than the air-discharge valve 25, an upper end of the sub-tank 50, and the open-close valve 24 in the vertical direction. In other words, the ink-ejection surface 10*a* is located above the air-discharge valve 25 in the vertical direction, the upper end of the sub-tank 50, and the open-close valve 24. Further, in the present embodiment, a water head difference of the ink-ejection surface 10*a* with respect to the open-close valve 24 falls within a range from −100 mmAq to −20 mmAq. That is, "H1" indicated in FIG. 2 (a height difference between the ink-ejection surface 10*a* and the open-close valve 24 in the vertical direction) falls within the range from 20 mmAq to 100 mmAq.

Figure 3:
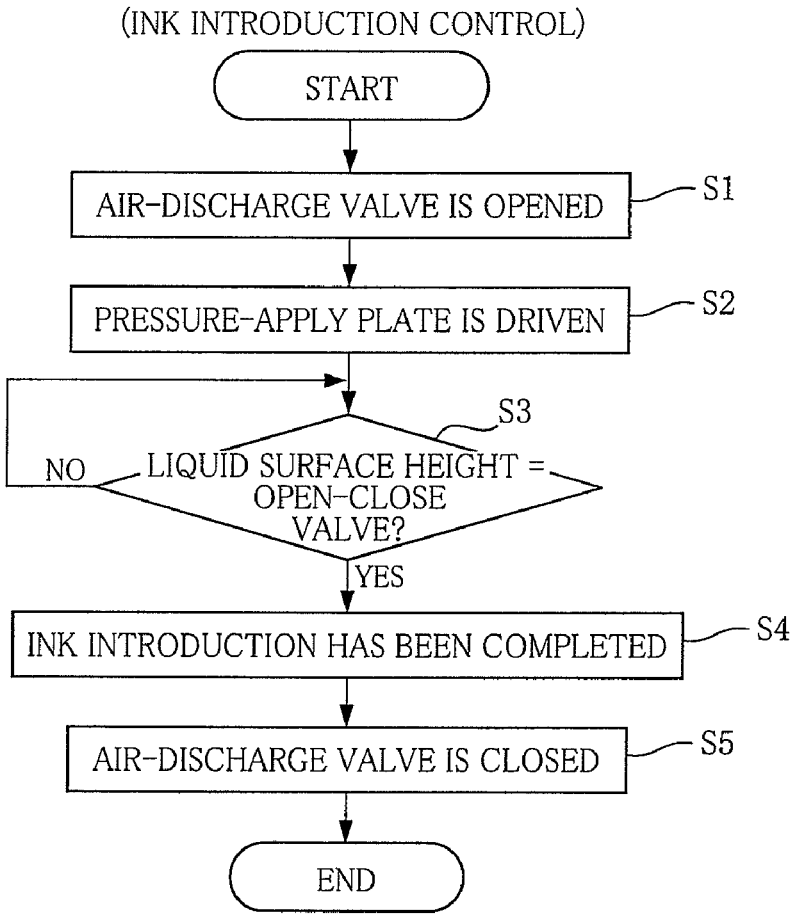
FIG. 3 is a flowchart showing a control by a controller in ink introduction.
Figure 4:
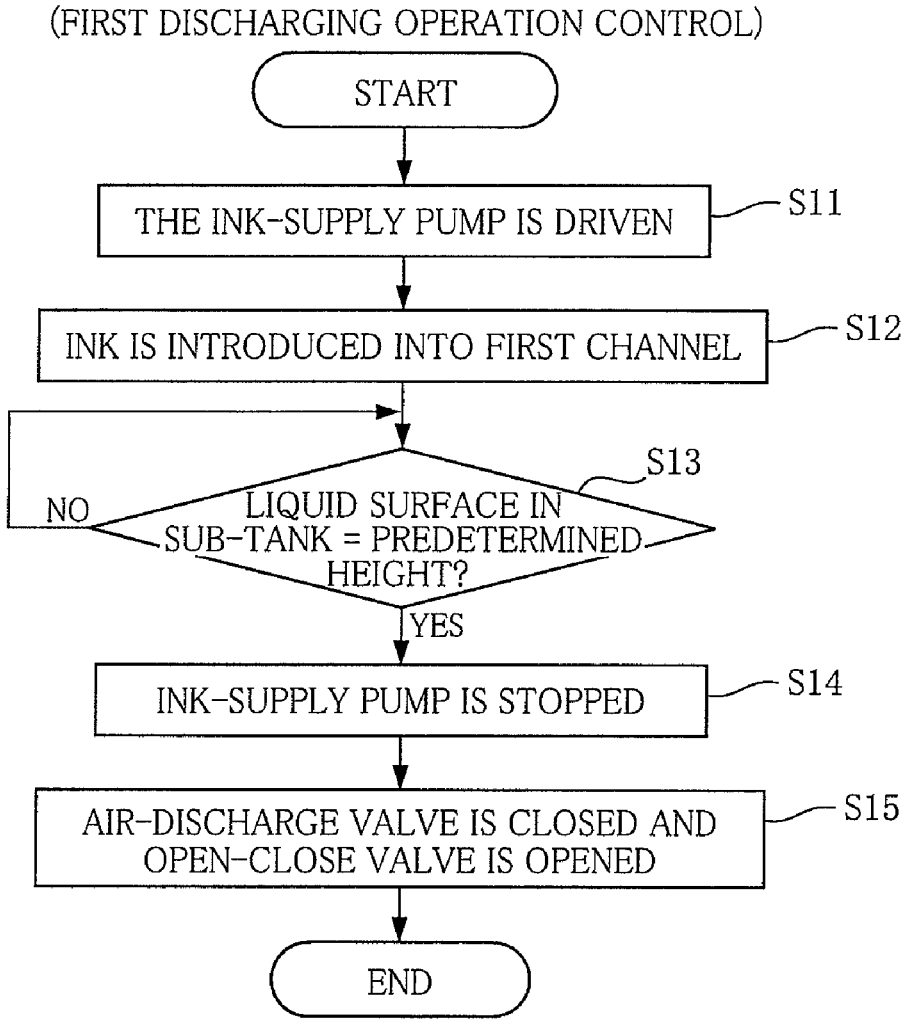
FIG. 4 is a flowchart showing a control by the controller in a first discharging operation of air discharging.
Figure 5:
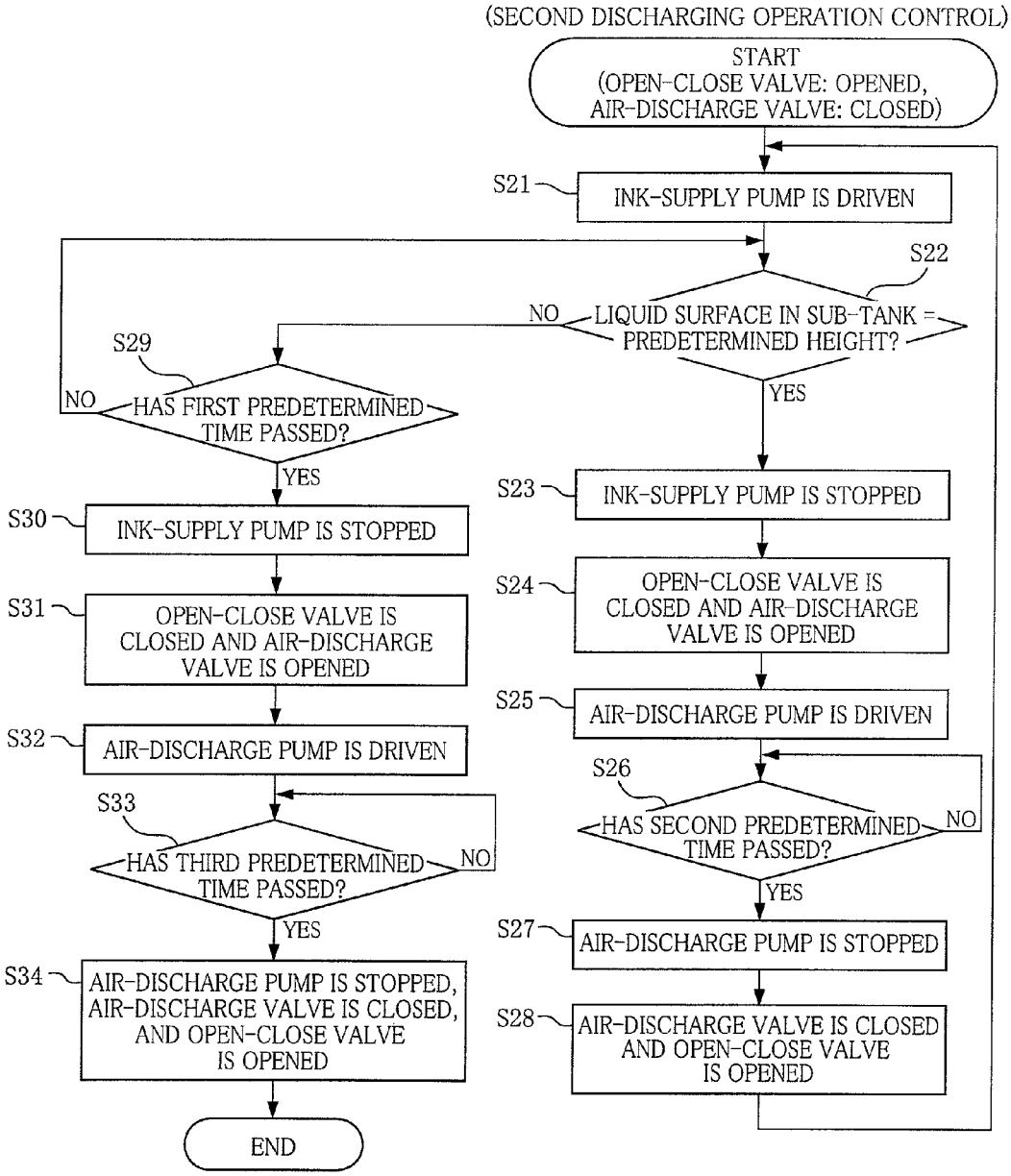
FIG. 5 is a flowchart showing a control by the controller in a second discharging operation of the air discharging.

There will be next explained, with reference to FIGS. 3, 4, and 5, operations of the controller 100 configured to control various operations of the components of the printer 1. More specifically, there will be explained (a) a "ink introduction control" (corresponding to FIG. 3) in which the ink is introduced from the main tank 21 into the ink-supply pump 22, and (b) an "air discharging control" or an air discharging control (corresponding to FIGS. 4 and 5) in which the ink is flowed through the first channel 41 by driving of the ink-supply pump 22, and air separated from the ink in the sub-tank 50 is discharged from the ambient-air-communicating opening 35*a* to the ambient air through the third channel 43.

Here, the "ink introduction control" is performed in an initial setting of the printer 1, and the "air discharging control" includes a "first discharging control" performed after the ink introduction in the initial setting of the printer 1 and a "second discharging control" which is performed when a specific condition is satisfied after the initial setting and in which the ink is flowed through the first channel 41 in a state that the ink exists in the first channel 41. For example, the initial setting is performed when the ink is initially introduced into the printer 1, and when the main tank 21 is replaced. Further, the specific condition is a condition required for the air discharging because an amount of air in the channels 41, 42 is larger than a prescribed amount on the basis of an elapsed time from the initial setting, an elapsed time from a previous air discharging operation, a temperature change, and the like. In detecting the condition, there may be used a timer, a temperature sensor provided in the printer 1, the sensor 55 provided on the sub-tank 50, and the like.

As shown in FIG. 3, in the "ink introduction control", the controller 100 initially changes in S1 the air-discharge valve 25 in a closed state in which the air-discharge valve 25 is closed to an open state in which the air-discharge valve 25 is opened, and then drives in S2 the pressure-apply plate 21*b* in a state in which the air-discharge valve 25 and the open-close valve 24 are opened (i.e., in their open state). As a result, the ink in the ink bag 21*a* of the main tank 21 is introduced into the ink-supply pump 22. In this time, a speed of the introduction of the ink may be adjusted by adjusting resistance of the air-discharge valve 25, thereby preventing generation of air bubbles owing to sudden and strong introduction of the ink, for example. Further, where the ink is accommodated in the sub-tank 50 in the introduction, the ink is introduced from the circulation opening 53 of the sub-tank 50 into the ink-supply pump 22 via the tube 34. The ink is also introduced not only into the ink-supply pump 22 but also into the channels extending from the ink-supply pump 22 toward the air-discharge valve 25 via the tubes 32, 34. When the controller 100 has detected that the ink has reached a height of the open-close valve 24 on the basis of a signal from, e.g., a sensor configured to detect a liquid surface in the second channel 42, for example (S3: YES), that is, a liquid surface height becomes equal to the height of the open-close valve 24, the controller 100 judges that the "ink introduction" has been completed in S4. Then, the controller 100 changes in S5 the open-close valve 24 to a closed state in which the open-close valve 24 is closed, and completes the ink introduction control. Next, the "first discharging control" is continuously performed.

As shown in FIG. 4, in the "first discharging control", the controller 100 initially drives in S11 the ink-supply pump 22 while maintaining the closed state of the open-close valve 24 and the open state of the air-discharge valve 25, and thereby introduces in S12 the ink into the first channel 41 including the head 10 and the sub-tank 50 along black arrow in FIG. 2. In this time, since the open-close valve 24 is in the closed state, the ink-supply pump 22 uses the ink in the main tank 21 without using the ink in the sub-tank 50 to introduce the ink into the first channel 41. That is, the ink-supply pump 22 introduces the ink in the main tank 21 into the first channel 41, thereby enabling the ink introduction in a state in which the air (i.e., the air bubbles) is not included in the ink. In the sub-tank 50, with the liquid surface of the ink rising, the ink and the air are separated from each other, so that the air is discharged from the ambient-air-communicating opening 35*a* to the ambient air via the tube 35. Here, since the connection opening 51 is provided on the lower portion of the sub-tank 50, the ink is flowed from a portion of the sub-tank 50 which is lower than the ink liquid surface thereof in height. Thus, unnecessary air bubbles are not generated when the ink is flowed into the sub-tank 50. The controller 100 receives a detection signal relating to a height of the liquid surface of the ink in the sub-tank 50 from the sensor 55, and when the liquid surface of the ink in the sub-tank 50 is lowered to reach a predetermined height (for example, a height of the upper end of the sub-tank 50) (S13: YES), the controller 100 stops in S14 the driving of the ink-supply pump 22 on the basis of the signal. Then, after S15 in which the air-discharge valve 25 is changed to the closed state, and the open-close valve 24 is changed to an open state in which the open-close valve 24 is opened, the "first discharging operation" is completed.

After the operation relating to the initial setting of the printer 1 in times other than predetermined period in the "second discharging control" which will be described below, the controller 100 controls the air-discharge valve 25 to be kept in the closed state. That is, each of the channels 41, 42 including the head 10 and so on in the present embodiment is of what is called a airtight state or airtight type in which each of the channels 41, 42 is interrupted from the ambient air in the times other than predetermined operations.

As shown in FIG. 5, in the "second discharging control", the controller 100 initially drives in S21 the ink-supply pump 22 while maintaining the open state of the open-close valve 24 and the closed state of the air-discharge valve 25, whereby the ink is circulated along the first channel 41 extending along the black arrow in FIG. 2 and the second channel 42 extending from the sub-tank 50 to the ink-supply pump 22 via the tube 34. As a result, the ink and the air are separated from each other in the sub-tank 50, so that the air is accumulated in an upper portion of the sub-tank 50. The controller 100 receives the detection signal relating to the height of the liquid surface of the ink in the sub-tank 50 from the sensor 55, and when the liquid surface of the ink in the sub-tank 50 is lowered to reach a predetermined height (for example, a position slightly higher than the connection opening 51) within a first predetermined time (S22: YES), the controller 100 stops in S23 the driving of the ink-supply pump 22 on the basis of the signal. Here, where the predetermined value of the liquid surface in S22 is set to the position slightly higher than the connection opening 51, there can be prevented that the unnecessary air bubbles are generated while the ink is introduced into the sub-tank 50.

After S23, the controller 100 changes in S24 the open-close valve 24 to the closed state and the air-discharge valve 25 to the open state, and drives the air-discharge pump 80 in S25. As a result, the accumulated air is discharged from the ambient-air-communicating opening 35*a* to the ambient air via the tube 35 along white arrow in FIG. 2. Then, when the controller 100 has judged that a second predetermined time (determined by an air-discharge speed at which the air is discharged by the air-discharge pump 80 and an air discharged volume to the upper end of the sub-tank 50 from the liquid surface of the ink in the sub-tank 50 at a timing in which the controller 100 has judged that the result in S22 is "YES") has passed from start of driving of the air-discharge pump 80 (S26: YES), the controller 100 stops in S27 the driving of the air-discharge pump 80. Then, after the controller 100 has changed in S28 the air-discharge valve 25 to the closed state and the open-close valve 24 to the open state, a processing of the "second discharging operation" returns to S21, and the controller 100 restarts the "second discharging operation".

After the driving of the ink-supply pump 22 is restarted in S21, where the liquid surface of the ink in the sub-tank 50 is lowered to reach the predetermined height within the first predetermined time (S22: YES), the operations described above are repeated. On the other hand, where the height of the liquid surface of the ink in the sub-tank 50 has not reached the predetermined value even where the first predetermined time has passed (S22: NO and S29: YES), the controller 100 stops in S30 the driving of the ink-supply pump 22 at a timing at which the first predetermined time has passed. Here, the first predetermined time is set to a time more than the second predetermined time. Next, the controller 100 changes in S31 the open-close valve 24 to the closed state and the air-discharge valve 25 to the open state, and drives the air-discharge pump 80 in S32. Then, when the controller 100 has judged that a third predetermined time (determined by the air-discharge speed by the air-discharge pump 80 and the air discharged volume to the air-discharge valve 25 from the liquid surface of the ink in the sub-tank 50 at a timing in which the controller 100 has judged that the result in S22 is "NO") has passed from the start of the driving of the air-discharge pump 80 (S33: YES), the controller 100 stops in S34 the driving of the air-discharge pump 80, and changes the air-discharge valve 25 to the closed state and the open-close valve 24 to the open state. At a time in S34, a distal end of the ink in the third channel 43 has reached a position of the air-discharge valve 25 or a position slightly nearer to the ambient-air-communicating opening 35*a* than the air-discharge valve 25. As a result, there is formed an ink-supply system of what is called the airtight state or airtight type in which no air (no air bubbles) exists in channels including the first channel 41, the second channel 42, and a part of the third channel 43 which extends from the sub-tank 50 to the air-discharge valve 25.

In the present embodiment, the controller 100 changes the open-close valve 24 to the closed state in S24 and S31 which are performed before the start of the driving of the air-discharge pump 80, but the present invention is not limited to this configuration, that is, the open-close valve 24 may be in the open state. Like in the present embodiment, where the air-discharge pump 80 is driven after the controller 100 changes the open-close valve 24 to the closed state in S24 and S31, the ink is supplied from the first channel 41 to the third channel 43 via the sub-tank 50. On the other hand, where the air-discharge pump 80 is driven in a state in which the open-close valve 24 is in the open state, the first channel 41 and the second channel 42 are communicated in parallel with the sub-tank 50. Thus, even where the air is accumulated in the second channel 42, the air is reliably discharged via the sub-tank 50. Further, in this case, since a channel resistance from the main tank 21 to the sub-tank 50 is lowered, a negative pressure applied by the air-discharge pump 80 to the head 10 is lowered. Thus, a meniscus of the ink formed in the ink-ejection openings of the head 10 is less broken, so that the air-discharge speed by the air-discharge pump 80 can be made higher accordingly.

In the present embodiment, the water head difference of the ink-ejection surface 10*a* of the head 10 with respect to the open-close valve 24 falls within the range from −100 mmAq to −20 mmAq, but the present invention is not limited to this configuration. For example, a water head difference of the ink-ejection surface 10*a* of the head 10 with respect to the liquid surface of the ink in the sub-tank 50 may fall within the range from −100 mmAq to −20 mmAq. That is, a height difference between the ink-ejection surface 10*a* of the head 10 and the liquid surface of the ink in the sub-tank 50 falls within the range from 20 mmAq to 100 mmAq. Further, a water head difference of the ink-ejection surface 10*a* of the head 10 with respect to the air-discharge valve 25 may fall within the range from −100 mmAq to −20 mmAq. That is, a height difference between the ink-ejection surface 10*a* of the head 10 and the air-discharge valve 25 falls within the range from 20 mmAq to 100 mmAq.

It is noted that, in each of the above-described operations, the controller 100 controls the components such that the meniscus of the ink formed in the ink-ejection openings of the head 10 is not broken.

As described above, according to the present embodiment, since the controller 100 controls the air-discharge valve 25 to be temporarily in the open state and to be kept in the closed state in the times other than the predetermined period, the ink in the channels 41, 42 including the head 10 is not exposed to the ambient air for a relatively long time. Thus, a problem that the ink is ejected unstably owing to a rise of a viscosity of the ink does not arise, thereby assuring ink-ejection stability.

The main tank 21 is disposed such that the ink in the main tank 21 applies the positive pressure to the ink-supply pump 22 in the "ink introduction", and the introduction of the ink into the ink-supply pump 22 is performed not by the driving of the ink-supply pump 22 but by the pressure of the ink in the main tank 21. Thus, since the driving of the ink-supply pump 22 in a state in which no ink exists in the ink-supply pump 22 can be avoided, there do not occur problems such as wear deterioration of the ink-supply pump 22, generation of foreign materials, and the like caused by idle running of the ink-supply pump 22. Further, since the driving of the ink-supply pump 22 in a state in which the air and the ink are mixed in the ink-supply pump 22 can be avoided, problems such as generation of the air bubbles by agitation, and the like do not occur. Further, compared to a case in which the "ink introduction" is performed by the driving of the ink-supply pump 22, the ink can be introduced stably, and it can be prevented that the ink is discarded more than necessary. In addition, even where a non-self-priming pump (e.g., an impeller pump and a turbopump) which normally requires a means for introducing priming is employed as the ink-supply pump 22, the means for introducing priming need not be provided. Further, since a choice of options of the ink-supply pump is increased by the above-described configuration, problems such as generation of the foreign materials by sliding in using a pump of a volume-change type do not occur by avoiding employment of the pump of the volume-change type, and it is possible to employ, as the ink-supply pump 22, the impeller pump which simplifies, e.g., construction of the channels and is economical compared to, e.g., a tube-type pump.

The pressure-apply plate 21*b* which applies the pressure to the ink in the main tank 21, and, in the ink introduction, the controller 100 changes the air-discharge valve 25 to the open state and controls the pressure-apply plate 21*b* such that the ink in the main tank 21 is introduced into the ink-supply pump 22. Thus, the above-described effects in the ink introduction can be obtained more reliably.

The printer 1 includes the air-discharge pump 80 which discharges the air in the sub-tank 50 from the air-discharge opening 52, and, in the air discharging shown in FIGS. 4 and 5, when the air is discharged from the sub-tank 50 by changing of the air-discharge valve 25 to the open state, the controller 100 drives the air-discharge pump 80 (in S15 and S26). By the driving of the air-discharge pump 80, the discharging of the air from the sub-tank 50 is promoted, thereby avoiding problems caused by the air in the channels more reliably.

The printer 1 includes the open-close valve 24 provided in the second channel 42, and the controller 100 changes the open-close valve 24 to the open state in the ink introduction. Thus, the ink in the sub-tank 50 can be introduced into the ink-supply pump 22, thereby leading to lower cost of the printer 1.

The controller 100 controls the open-close valve 24 to be kept in the closed state in the first discharging control shown in FIG. 4, and changes the open-close valve 24 to the open state in S15 after the operation has been completed. By keeping the closed state of the open-close valve 24 in the first discharging control as thus described, the ink-supply pump 22 introduces the ink only from the main tank 21. Thus, the sub-tank 50 needs only relatively small volume, thereby enabling a downsizing of the sub-tank 50. Further, a problem that the ink with which the air bubbles in the sub-tank 50 are mixed is introduced into the ink-supply pump 22 can be avoided. Further, in a case where a liquid in the channel is replaced with another liquid, e.g., in a case where the ink is replaced with the ink of another color, a mixture of an unnecessary liquid can be prevented, thereby realizing the replacement in a relatively short time.

In the second discharging control shown in FIG. 5, the controller 100 changes the open-close valve 24 to the closed state (in S24 and S31) before the air is discharged from the sub-tank 50 by changing of the air-discharge valve 25 to the open state, and the controller 100 changes the air-discharge valve 25 to the closed state and the open-close valve 24 to the open state (in S28 and S34) after the air is discharged. Here, at least one of the second predetermined time in S26 and the third predetermined time in S33 may be set to a time in which at least a part of the ink in the sub-tank 50 is discharged from the ambient-air-communicating opening 35*a* to the ambient air. Thus, the ink in the sub-tank 50 whose viscosity has risen can be discarded with the air without mixing with the ink accommodated in the main tank 21.

Like the present embodiment, in the case where the controller 100 judges that the "ink introduction" has been completed when the ink has reached the height of the open-close valve 24, since the ink-ejection surface 10*a* of the head 10 is located above the open-close valve 24, there is prevented leakage of the ink from the ink-ejection openings in the ink introduction.

The printer 1 includes the sensor 55 which detects the position of the liquid surface of the ink in the sub-tank 50, and the controller 100 controls the opening and closing of the air-discharge valve 25 (with reference to S13 in FIG. 4 and S23 in FIG. 5) on the basis of the detection of the sensor 55. Thus, the air can be discharged via the air-discharge valve 25 at a proper timing on the basis of the liquid surface detected by the sensor 55.

While the preferred embodiment of the present invention has been described, it is to be understood that the present invention is not limited to the details of the illustrated embodiment, but may be embodied with various changes and modifications, which may occur to those skilled in the art, without departing from the spirit and scope of the present invention.

For example, in the above-described embodiment, there is provided the sensor 55 which detects the liquid surface of the ink in the sub-tank 50, but the present invention is not limited to the sensor which detects only an inside of the sub-tank 50. That is, there may be provided a sensor (the detecting portion) which detects a liquid surface of the ink in a channel extending from the sub-tank 50 to the air-discharge valve 25. It is noted that the sensor 55 is not essential in the present invention and may be omitted.

The open-close valve 24 and/or the air-discharge pump 80 may be omitted, and the controls of the controller 100 for the omitted at least one of the open-close valve 24 and the air-discharge pump 80 may be omitted. As modifications of the ink-jet printer 1 according to the above-described embodiment, FIG. 6 shows an ink-jet printer 201 from which the open-close valve 24 is omitted while FIG. 7 shows an ink-jet printer 301 from which the open-close valve 24 and the air-discharge pump 80 are omitted.

Figure 6:
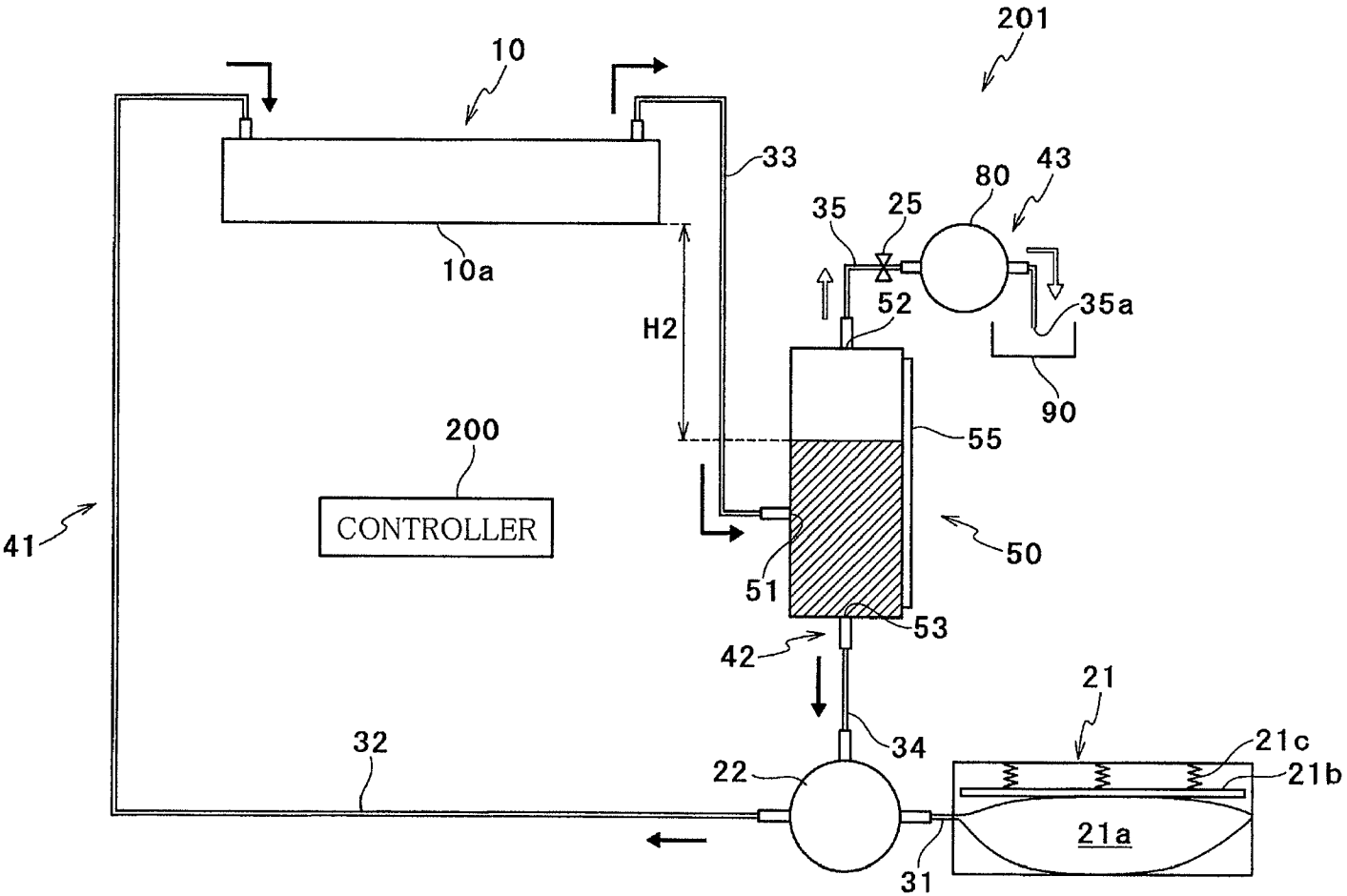
FIG. 6 is a schematic view showing an ink jet printer as a modification of the embodiment.

In the printer 201 in FIG. 6 as the modification, a controller 200 judges that an "ink introduction" has been completed when having detected that the ink has reached a height of the sub-tank 50 (i.e., the upper portion thereof) on the basis of a signal from, e.g., a sensor which detects the liquid surface. Although a first discharging control and a second discharging control following an ink introduction control are respectively similar to those in the above-described embodiment, there is a difference that the opening and closing of the open-close valve 24 are not performed in this modification. In this modification, since the first channel 41 and the second channel 42 are communicated in parallel with the sub-tank 50, the air is less accumulated in the second channel 42. Further, since the channel resistance from the main tank 21 to the sub-tank 50 is lowered, the negative pressure applied by the air-discharge pump 80 to the head 10 is lowered. Thus, the meniscus of the ink formed in the ink-ejection openings of the head 10 is less broken, so that the air-discharge speed by the air-discharge pump 80 can be made higher accordingly. Further, in the printer 201 in FIG. 6, a water head difference of the ink-ejection surface 10*a* of the head 10 with respect to the liquid surface of the ink in the sub-tank 50 falls within a range from −100 mmAq to −20 mmAq. That is, "H2" indicated in FIG. 5 (a height difference between the ink-ejection surface 10*a* and the liquid surface of the ink in the sub-tank 50 in the vertical direction) falls within the range from 20 mmAq to 100 mmAq. It is noted that, as to a setting of the water head difference, the water head difference of the ink-ejection surface 10*a* of the head 10 with respect to the air-discharge valve 25 may fall within the range from −100 mmAq to −20 mmAq. A height difference between the ink-ejection surface 10*a* and air-discharge valve 25 in the vertical direction may fall within the range from 20 mmAq to 100 mmAq.

Figure 7:
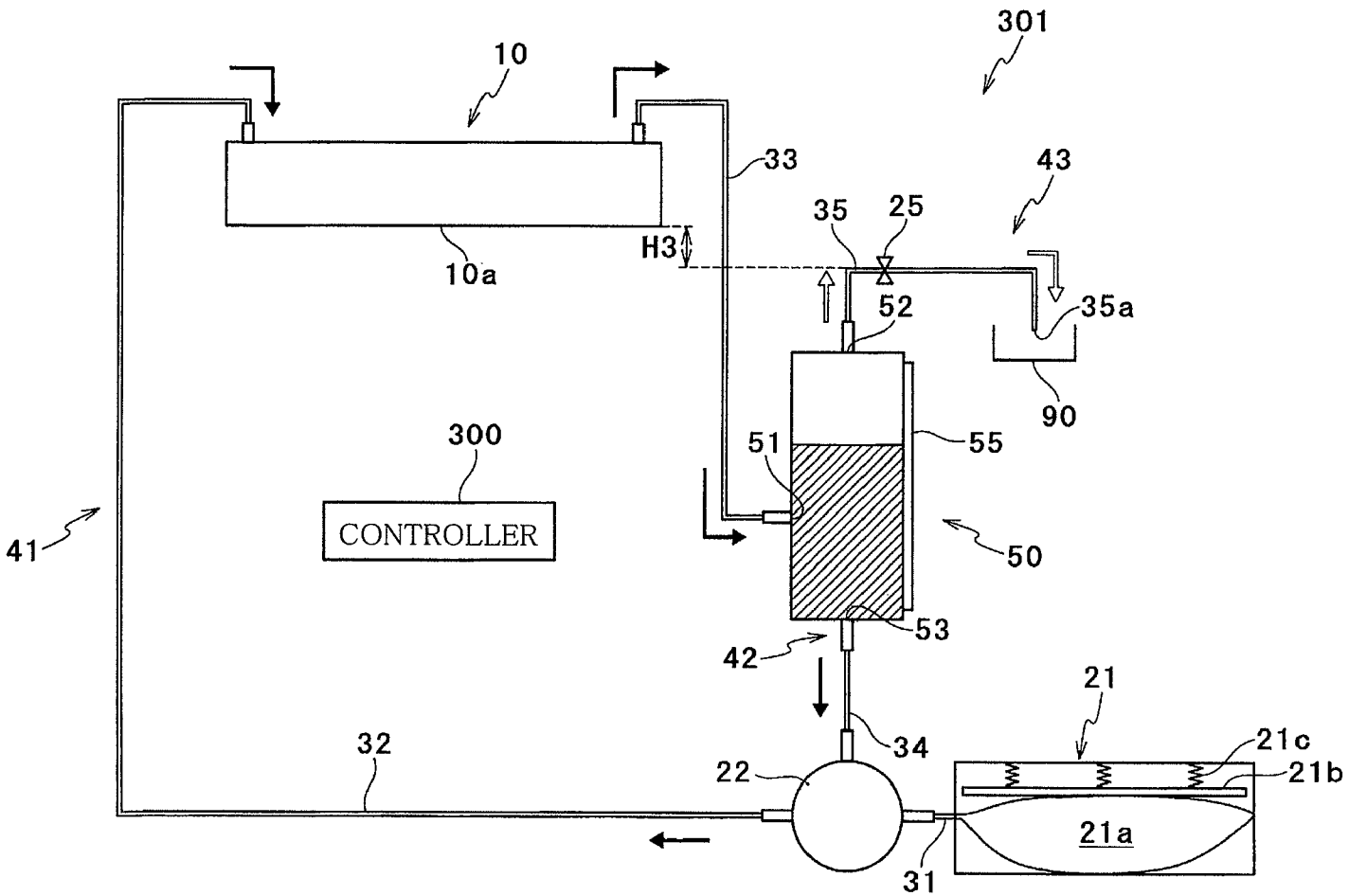
FIG. 7 is a schematic view showing an ink-jet printer as another modification of the embodiment.

In the printer 301 in FIG. 7 as the modification, a controller 300 judges that an "ink introduction" has been completed when having detected that the ink has reached a height of the air-discharge valve 25 on the basis of a signal from, e.g., a sensor which detects the liquid surface. Further, in the printer 301, a water head difference of the ink-ejection surface 10*a* of the head 10 with respect to the air-discharge valve 25 falls within a range from −100 mmAq to −20 mmAq. That is, "H3" indicated in FIG. 7 (a height difference between the ink-ejection surface 10*a* and the air-discharge valve 25 in the vertical direction) falls within the range from 20 mmAq to 100 mmAq. Here, a first discharging control and a second discharging control following an ink introduction control are respectively different from those in the above-described embodiment and are relatively simple. Specifically, in the second discharging control, the controller 301 initially changes the air-discharge valve 25 to the closed state, and then the ink-supply pump 22 is driven to start a circulation of the ink. In this time, the air in the head 10 is flowed into and accumulated in the sub-tank 50 with the ink. In this modification, a volume of a portion of the sub-tank 50 which is higher than the connection opening 51 is larger than that of channels (including the head 10) higher than the air-discharge valve 25. Thus, where a specific time has passed, increase of the air in the sub-tank 50 is stopped. Where, in this state, the air-discharge valve 25 is changed to the open state, the ink in the main tank 21 is pressed by the pressure-apply plate 21*b* and thus the liquid surface of the ink in the sub-tank 50 rises and reaches the height of the air-discharge valve 25. In this time, the controller 301 has judged that the ink has reached the height of the air-discharge valve 25 on the basis of the signal from, e.g., the sensor which detects the liquid surface, and changes the air-discharge valve 25 to the closed state. As a result, the ink-supply system of the airtight state or airtight type is formed. It is noted that, as to the setting of the water head difference, the water head difference of the ink-ejection surface 10*a* of the head 10 with respect to the liquid surface of the ink in the sub-tank 50 may fall within the range from −100 mmAq to −20 mmAq. That is, a height difference between the ink-ejection surface 10*a* and the liquid surface of the ink in the sub-tank 50 in the vertical direction may fall within the range from 20 mmAq to 100 mmAq.

In the construction of the printer as each of the modifications shown in FIGS. 6 and 7, the above-described water head difference is set within the range, thereby preventing the ink from being discharged more than necessary even where there occurs a failure of the air-discharge valve 25, a malfunction of the sensor, and the like.

The present invention is not limited to the construction of the above-described embodiment and each modification, and a water head difference of the ink-ejection surface 10*a* with respect to the liquid surface of the ink introduced into at least one of the first channel 41, the second channel 42, and the third channel 43 in the ink introduction may fall within the range from −100 mmAq to −20 mmAq. That is, a height difference in the vertical direction between the ink-ejection surface 10*a* and the liquid surface of the ink introduced into the at least one of the first channel 41, the second channel 42, and the third channel 43 in the ink introduction may fall within the range from 20 mmAq to 100 mmAq. Alternately, this water head difference may not be formed.

The controller 100 may judge that the "ink introduction" has been completed when the ink has reached a back-pressure setting position or a position at which a pressure balance is achieved, which positions are other than the above-described positions. In this case, the height of the liquid surface of the ink at a completion of the ink introduction is determined by, e.g., an ability of the ink-supply pump 22, and the controller may judge that the "ink introduction" has been completed on the basis of, e.g., a change of a driving current of the ink-supply pump 22 without performing the operation (e.g., S3) for detecting the liquid surface of the ink like the above-described embodiment or each modification.

The operations in the "ink introduction" and the "air discharging" are not limited to the above-described operations and may be variously changed or modified. For example, the ink in the main tank 21 is not limited to be introduced also into the channels extending from the ink-supply pump 22 to the tubes 32, 34 to reach the air-discharge valve 25 in the "ink introduction", but may be introduced into only the ink-supply pump 22. Further, in the "air discharging", when the air in the sub-tank 50 is discharged from the air-discharge opening 52, the controller 100 controls the driving of the air-discharge pump 80 in the above-described embodiment, but may control driving of at least one of the ink-supply pump 22 and the pressure-apply plate 21*b* of the main tank 21. In this case, the air in the sub-tank 50 can be discharged without providing the air-discharge pump 80 and the like, thereby simplifying the configuration of the printer.

As a means applying a pressure to the ink in the main tank 21, the pressure-apply plate 21*b* is employed in the above-described embodiment, but other members, mechanisms, and the like may be employed. Further, this means may not be provided.

The main tank 21 may not be disposed such that the ink in the main tank 21 applies the positive pressure to the ink-supply pump 22 in the "ink introduction". It is noted that, in the above-described embodiment, in the second the second discharging operation shown in FIG. 5, where the ink-supply pump 22 is driven, the air-discharge valve 25 is closed, but the present invention is not limited to this configuration. That is, where the ink-supply pump 22 is driven, the air-discharge valve 25 may be opened.

The "second discharging control" in the above-described embodiment is for coping with a case where the air cannot be sufficiently discharged by one air-discharge operation. However, where the printer has a configuration in which the air can be sufficiently discharged by one air-discharge operation, a procedure of the air-discharge operation may be simplified. There will be explained a procedure in this case.

Figure 8:
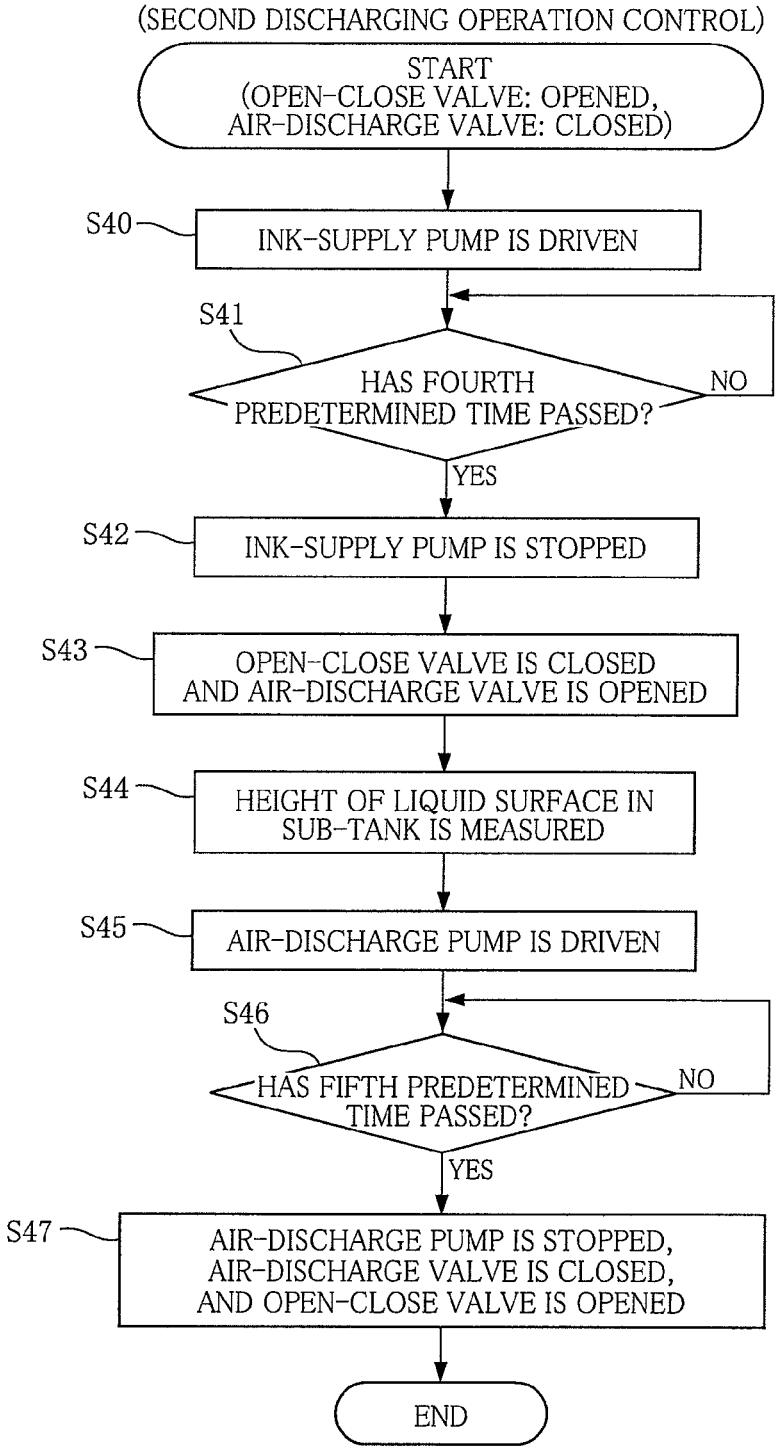
FIG. 8 is a flowchart showing a modification of the control by the controller in the second discharging operation of the air discharging.

As shown in FIG. 8, in the "second discharging control", the controller 100 drives in S40 the ink-supply pump 22 while maintaining the open state of the open-close valve 24 and the closed state of the air-discharge valve 25. Then, when the controller 100 has judged that a fourth predetermined time (i.e., a time in which when the ink is circulated by the ink-supply pump 22, all air remaining in a circulation channel is accumulated in the sub-tank 50) has passed from the start of the driving of the ink-supply pump 22 (S41: YES), the controller 100 stops in S42 the driving of the ink-supply pump 22. Then, the controller 100 changes in S43 the open-close valve 24 to the closed state and the air-discharge valve 25 to the open state. Next, the controller 100 detects or measures in S44 the height of the liquid surface of the ink in the sub-tank 50 by the sensor 55. The controller 100 calculates an air discharged volume from the liquid surface of the ink in the sub-tank 50 to the air-discharge valve 25 on the basis of the signal from the sensor 55, and calculates a time (a fifth predetermined time, a calculated value) of the driving of the air-discharge pump 80 on the basis of the air discharged volume and the air-discharge speed by the air-discharge pump 80. Then, the controller 100 starts in S45 the driving of the air-discharge pump 80, and when the controller 100 has judged that the fifth predetermined time has passed from the start of the driving of the air-discharge pump 80 (S46: YES), the controller 100 stops in S47 the driving of the air-discharge pump 80 and changes the air-discharge valve 25 to the closed state and the open-close valve 24 to the open state. At this time, the distal end of the ink in the third channel 43 reaches the position of the air-discharge valve 25 or the position slightly nearer to the ambient-air-communicating opening 35*a* than the air-discharge valve 25. As a result, there is formed the ink-supply system of what is called the airtight state or airtight type in which no air (no air bubbles) exists in the channels including the first channel 41, the second channel 42, and the part of the third channel 43 which extends from the sub-tank 50 to the air-discharge valve 25.

In each of the above-described embodiment and the modifications, a wiping operation in which the ink-ejection surface 10*a* is wiped by a wiper may be performed after the air-discharge operation has been completed, or a purging operation in which the ink is forced to be ejected from the ink-ejection openings after the air-discharge operation has been completed, and then the wiping operation may be performed. Although there is a possibility of a leakage of the ink from the ink-ejection surface 10*a* during the operations of the ink introduction and the air discharging, performing the operation such as the wiping operation and the purging operation can keep the ink-ejection surface 10*a* clean and can prevent generation of an ink-ejection failure. Further, where image forming on the sheet P is not required thereafter, the ink-ejection surface 10*a* may be covered with a cap, thereby preventing a thickening of the ink near the ink-ejection openings. On the other hand, where the image forming on the sheet P is required, an image forming processing for forming an image on the sheet P on the basis of image data is performed while the controller stops the driving of the ink-supply pump 22 and keeps the open-close valve 24 being in the open state.

The liquid-ejection apparatus according to the present invention is applicable to both of a line-type printer and a serial-type printer and also applicable to a facsimile, a copying machine, and the like without being limited to the printer. Further, the liquid-ejection apparatus is applicable to an apparatus configured to eject a liquid different from the ink.

What is claimed is:

1. A liquid-ejection apparatus, comprising:

a head configured to eject a liquid from a plurality of liquid-ejection openings;

a main tank configured to accommodate the liquid supplied to the head;

a liquid-supply pump configured to supply the liquid in the main tank to the head;

a sub-tank in which are formed (a) a connection opening for connecting the sub-tank to the head and (b) an air-discharge opening for communicating the sub-tank with ambient air;

a first channel extending from the liquid-supply pump to the sub-tank via the head and the connection opening;

a second channel extending from the sub-tank to the liquid-supply pump;

a third channel extending from the air-discharge opening of the sub-tank to the ambient air;

an air-discharge valve provided in the third channel so as to be openable and closable; and a controller configured to control operations of the liquid-ejection apparatus, wherein the controller controls the air-discharge valve such that the air-discharge valve is in its opened state in a state in which the liquid-supply pump is not driven in a liquid introducing operation in which the liquid is introduced from the main tank to the liquid-supply pump, wherein the controller controls the air-discharge valve such that the air-discharge valve is opened in an air discharging operation in which air that has been separated from the liquid inside the sub-tank by driving the liquid-supply pump to cause the liquid to be flowed through the first channel, is discharged through the third channel, and wherein the controller controls the air-discharge valve such that the air-discharge valve is closed in times other than the liquid introducing operation and the air discharging operation.

2. The liquid-ejection apparatus according to claim 1, wherein the main tank is disposed such that the liquid in the main tank applies a positive pressure to the liquid-supply pump at least in the liquid introducing operation.

3. The liquid-ejection apparatus according to claim 2, further comprising a pressure-apply portion configured to apply a pressure to the liquid in the main tank, wherein the controller is configured to control the pressure-apply portion such that the air-discharge valve is opened and the liquid in the main tank is introduced into at least the liquid-supply pump in the liquid introducing operation.

4. The liquid-ejection apparatus according to claim 3, wherein the controller is configured to control the pressure-apply portion such that the liquid in the main tank is introduced toward the air-discharge valve via the liquid-supply pump in the liquid introducing operation.

5. The liquid-ejection apparatus according to claim 1, wherein the head has a liquid-ejection surface in which the plurality of liquid-ejection openings are formed, and wherein a water head difference of the liquid-ejection surface with respect to a liquid surface of the liquid introduced into at least one of the first channel, the second channel, the third channel, and the sub-tank falls within a range from −100 mmAq to −20 mmAq in the liquid introducing operation.

6. The liquid-ejection apparatus according to claim 1, wherein the controller is configured to control the air-discharge valve to be opened in the liquid introducing operation, and wherein the controller is configured to drive the liquid-supply pump to cause the liquid to be flowed through the first channel in a state in which the air-discharge valve is opened, and then change the air-discharge valve from its opened state to its closed state after the controller has stopped the driving of the liquid-supply pump, in the air discharging operation.

7. The liquid-ejection apparatus according to claim 6, wherein the controller is configured to judge that the liquid introducing operation has been completed when a liquid surface of the liquid introduced into the third channel has reached a height of the air-discharge valve.

8. The liquid-ejection apparatus according to claim 6, wherein a liquid-ejection surface of the head in which the plurality of liquid-ejection openings are formed is located at a position higher than the air-discharge valve in a vertical direction.

9. The liquid-ejection apparatus according to claim 6, wherein a water head difference of a liquid-ejection surface of the head in which the plurality of liquid-ejection openings are formed with respect to the air-discharge valve falls within a range from −100 mmAq to −20 mmAq.

10. The liquid-ejection apparatus according to claim 1, further comprising an air-discharge pump disposed in the third channel at a position further from the air-discharge opening of the sub-tank than the air-discharge valve and configured to discharge the air in the sub-tank from the air-discharge opening, wherein the controller is configured to drive the air-discharge pump when the air is discharged from the sub-tank in a state in which the air-discharge valve is opened in the air discharging operation.

11. The liquid-ejection apparatus according to claim 10, wherein the controller is configured to control the air-discharge valve to be opened in the liquid introducing operation, and wherein the controller is configured to drive the liquid-supply pump in a state in which the air-discharge valve is opened, then stop the driving of the liquid-supply pump, then drive the air-discharge pump in the state in which the air-discharge valve is opened after the controller has stopped the driving of the liquid-supply pump, and then control the air-discharge valve to be closed after the controller has stopped the driving of the air-discharge pump, in the air discharging operation.

12. The liquid-ejection apparatus according to claim 11, wherein the controller is configured to judge that the liquid introducing operation has been completed when the liquid has reached a height of an upper end of the sub-tank.

13. The liquid-ejection apparatus according to claim 11, wherein a liquid-ejection surface of the head in which the plurality of liquid-ejection openings are formed is located at a position higher than an upper end of the sub-tank in a vertical direction.

14. The liquid-ejection apparatus according to claim 11, wherein a water head difference of a liquid-ejection surface of the head in which the plurality of liquid-ejection openings are formed with respect to a liquid surface in the sub-tank falls within a range from −100 mmAq to −20 mmAq.

15. The liquid-ejection apparatus according to claims 1, further comprising an open-close valve provided in the second channel, wherein the controller is configured to control the open-close valve to be opened in the liquid introducing operation.

16. The liquid-ejection apparatus according to claim 15, wherein the air discharging operation includes a first discharging operation in which the liquid is introduced into the first channel, and wherein the controller controls the open-close valve to be closed in the first discharging operation.

17. The liquid-ejection apparatus according to claim 16, wherein the controller is configured to control the open-close valve to be opened after the first discharging operation.

18. The liquid-ejection apparatus according to claim 17, wherein the air discharging operation further includes a second discharging operation performed after the first discharging operation, and wherein the controller is configured to control, in the second discharging operation, the open-close valve to be closed before the air is discharged from the sub-tank in a state in which the air-discharge valve is opened, and control the air-discharge valve to be closed and the open-close valve to be opened after the air is discharged from the sub-tank.

19. The liquid-ejection apparatus according to claim 15, wherein the controller is configured to control the air-discharge valve to be opened in the liquid introducing operation, and wherein the controller is configured to drive the liquid-supply pump to cause the liquid to be flowed through the first channel in a state in which the air-discharge valve is opened, and then control the air-discharge valve to be closed after the controller has stopped the driving of the liquid-supply pump, in the air discharging operation.

20. The liquid-ejection apparatus according to claim 19, wherein the controller is configured to judge that the liquid introducing operation has been completed when a liquid surface of the liquid introduced into the second channel has reached a height of the open-close valve.

21. The liquid-ejection apparatus according to claim 19, wherein a liquid-ejection surface of the head in which the plurality of liquid-ejection openings are formed is located at a position higher than the open-close valve in a vertical direction.

22. The liquid-ejection apparatus according to claim 19, wherein a water head difference of a liquid-ejection surface of the head in which the plurality of liquid-ejection openings are formed with respect to the open-close valve falls within a range from −100 mmAq to −20 mmAq.

23. The liquid-ejection apparatus according to claim 1, further comprising a detecting portion configured to detect a position of a liquid surface in a channel extending from the sub-tank to the air-discharge valve, wherein the controller is configured to control the opening and closing of the air-discharge valve on the basis of the position detected by the detecting portion.

24. The liquid-ejection apparatus according to claim 23, wherein the detecting portion is configured to detect a position of a liquid surface in the sub-tank, wherein the controller is configured to calculate an air discharged volume from the liquid surface to the air-discharge valve on the basis of the position of the liquid surface, and wherein the controller is configured to control the air-discharge valve on the basis of the air discharged volume calculated by the controller.

* * * * *